US010260225B2

(12) United States Patent
Lee

(10) Patent No.: US 10,260,225 B2
(45) Date of Patent: Apr. 16, 2019

(54) PRECAST CONCRETE MEMBER WITH PREFABRICATED PLATE AND FIXING CHANNELS

(71) Applicants: SEJONG R&D CO., LTD., Busan (KR); Jae Ho Lee, Busan (KR)

(72) Inventor: Jae Ho Lee, Busan (KR)

( * ) Notice: Subject to any disclaimer, the term of this patent is extended or adjusted under 35 U.S.C. 154(b) by 0 days.

(21) Appl. No.: 15/541,708

(22) PCT Filed: Jan. 5, 2016

(86) PCT No.: PCT/KR2016/000032
§ 371 (c)(1),
(2) Date: Jul. 5, 2017

(87) PCT Pub. No.: WO2016/111513
PCT Pub. Date: Jul. 14, 2016

(65) Prior Publication Data

US 2017/0356177 A1 Dec. 14, 2017

(30) Foreign Application Priority Data

Jan. 5, 2015 (KR) ..... 10-2015-0000704

(51) Int. Cl.
*E04B 1/21* (2006.01)
*E04B 1/58* (2006.01)
(Continued)

(52) U.S. Cl.
CPC ..... *E04B 1/215* (2013.01); *E04B 1/043* (2013.01); *E04B 1/58* (2013.01); *E04C 3/26* (2013.01);
(Continued)

(58) Field of Classification Search
CPC . E04B 1/215; E04B 1/043; E04B 1/58; E04B 1/4107; E04B 1/1903;
(Continued)

(56) References Cited

U.S. PATENT DOCUMENTS 2,724,261 A * 11/1955 Rensaa ..... E04B 1/0007 52/259
4,577,449 A * 3/1986 Celli ..... E04B 1/2403 182/186.8
(Continued)

FOREIGN PATENT DOCUMENTS

JP H07-150685 A 6/1995
JP H07-238590 A 9/1995
(Continued)

OTHER PUBLICATIONS

KR Grant of Patent dated Feb. 9, 2015 as received in Application No. 10-2015-0000704 (English Translation).

*Primary Examiner* — Ryan D Kwiecinski
*Assistant Examiner* — Matthew J Gitlin
(74) *Attorney, Agent, or Firm* — Maschoff Brennan

(57) ABSTRACT

The present invention relates to a precast concrete member using a PC member, which comprises a prefabricated plate and fixing channels, and is used as a linear member for a column which is an axial force member, as a planar member for a wall which is an axial force member, or as a linear member for a beam or a girder which is a flexural member. A preferred embodiment of the present invention provides a premade precast concrete member having a PC body formed at a predetermined length and multiple steel reinforcements embedded within the PC body along the longitudinal direction, the precast concrete member comprising: a plate assembly in which a pair of board-like plates having a pair of coupling holes formed to be penetrated at a regular interval are formed so as to be spaced apart from each other and to face each other, or two pairs of board-like plates are spaced apart from each other so as to face each other, with one end of each thereof being embedded into one or both longitudinal ends of the PC body, and the other ends thereof protruding, wherein the plate assembly comprises a con-
(Continued)

necting member of which a part embedded into the PC body of the plate is welded to one side of the steel reinforcement, and both ends are respectively bolt-coupled to the coupling holes of a pair of plates so as to connect a part embedded into the PC body of a pair of facing plates; and fixing channels which comprise a U-shaped channel having an opening formed on the top thereof and multiple anchor bodies coupled to the rear surface of the U-shaped channel, the opening of the U-shaped channel comprising a rib which is formed to be bent inwardly, wherein at least two rows of fixing channels are embedded at regular intervals into one side surface of the width direction of the PC body or into at least one pair of corresponding surfaces of the width direction of the PC body.

7 Claims, 10 Drawing Sheets

(51) Int. Cl.

| | |
|---|---|
| ***E04B 1/04*** | (2006.01) |
| ***E04C 5/01*** | (2006.01) |
| ***E04C 3/26*** | (2006.01) |
| ***E04C 3/34*** | (2006.01) |
| ***E04C 5/06*** | (2006.01) |
| *E04B 1/41* | (2006.01) |

(52) U.S. Cl.
CPC ..... *E04C 3/34* (2013.01); *E04C 5/01* (2013.01); *E04C 5/0645* (2013.01); *E04B 1/4107* (2013.01)

(58) Field of Classification Search
CPC ..... E04B 1/1975; E04B 1/24; E04B 1/2403; E04B 1/2001; E04B 1/2415; E04B 1/1418; E04B 2001/2445; E04B 2001/2448; E04B 2001/2463; E04C 3/34; E04C 3/26; E04C 5/0645; E04C 5/01
See application file for complete search history.

(56) References Cited

U.S. PATENT DOCUMENTS

| | | | | | |
|---|---|---|---|---|---|
| 4,951,438 | A * | 8/1990 | Thoresen | E04B 1/215 | 403/187 |
| 5,392,580 | A * | 2/1995 | Baumann | B21F 27/125 | 52/646 |
| 2003/0029111 | A1* | 2/2003 | Yabuuchi | E04B 1/14 | 52/425 |
| 2005/0072106 | A1* | 4/2005 | Hiragaki | E04C 3/04 | 52/831 |
| 2005/0097854 | A1* | 5/2005 | Tu | E04C 3/04 | 52/698 |
| 2006/0059841 | A1* | 3/2006 | Bennett | E04B 1/215 | 52/649.1 |
| 2007/0039281 | A1* | 2/2007 | Zambelli | E04B 1/4107 | 52/710 |
| 2008/0263978 | A1* | 10/2008 | Abou-Saleh | E04C 5/06 | 52/260 |
| 2009/0064626 | A1* | 3/2009 | Sen | E04B 1/4107 | 52/699 |
| 2009/0178356 | A1* | 7/2009 | Baumann | E04C 3/34 | 52/414 |
| 2010/0071315 | A1* | 3/2010 | Hong | E04B 1/215 | 52/848 |
| 2010/0146904 | A1* | 6/2010 | Heudorfer | E04B 1/4107 | 52/699 |
| 2014/0250825 | A1* | 9/2014 | Richardson | E04B 1/4107 | 52/710 |
| 2014/0318072 | A1* | 10/2014 | Lee | E04B 1/4107 | 52/699 |
| 2015/0240478 | A1* | 8/2015 | Brunhuber | E04B 1/4107 | 52/710 |
| 2016/0097192 | A1* | 4/2016 | Marquina | E04B 1/24 | 52/655.1 |
| 2016/0305115 | A1* | 10/2016 | Albartus | E04B 1/4107 | |

FOREIGN PATENT DOCUMENTS

| | | | |
|---|---|---|---|
| KR | 10-2009-0126076 | A | 12/2009 |
| KR | 10-2010-0043731 | A | 4/2010 |
| KR | 10-1058540 | B1 | 8/2011 |
| KR | 10-1071273 | B1 | 9/2011 |
| KR | 10-2013-0083876 | A | 7/2013 |

* cited by examiner

PRECAST CONCRETE MEMBER WITH PREFABRICATED PLATE AND FIXING CHANNELS

TECHNICAL FIELD

The present invention relates to a precast concrete (PC) member having assemblable plates and fixing channels, and more particularly, to a PC member having assemblable plates and fixing channels, used as a linear axial member such as a column, a planar axial member such as a wall, or a linear flexural member such as a girder or beam, and capable of easily and simply achieving column-to-column connection, column-to-girder connection, girder-to-girder connection, and wall-to-wall connection, and of easily coupling slab rebars to the PC member using the fixing channels.

BACKGROUND ART

In a conventional precast concrete (PC) member connection method, high-strength mortar is injected into empty oval spaces of PC member connection parts and rebars of PC members are interconnected at spliced parts. According to the above-described connection method, since the high-strength mortar is cured at the spliced parts, instantaneous coupling force may not be ensured and connection performance greatly differs depending on the quality of curing.

In another conventional PC member connection method, connection members called ductile rods are embedded and a PC member to be coupled is bolted to screw holes of the connection members (at least four screw holes in PC connection surfaces) on site. However, the center locations of the screw holes facing each other to be bolted together should be very accurate. That is, tolerance may not be achieved for on-site errors of PC technology and thus much effort and time are required for accurate location management.

In another conventional PC member connection method, brackets are integrally provided on a column and hardware to be connected to the brackets is provided on a girder or beam, thereby coupling the column and the girder together. However, the above-described coupling structure is applicable only to non-finished parts due to protrusions such as the brackets. In addition, connection parts between PC members have little resistance against lateral force and are defenseless against lateral force generated during construction.

A background technology of the present invention is disclosed in KR 1058540 entitled "Dry Joint Structure of Precast Concrete Beam and Column Unit with Bolt Connector". This background technology discloses 'a PC column-to-girder connection structure including a PC column 10 having embedded rebars 12 therein and having coupling holes 13 at a certain height of a body to expose screw holes 23' on a side surface thereof, and PC girders or beams 11 and 11' in which ends of rebars 14 are embedded and from which other ends of the rebars 14 horizontally protrude, wherein the PC column 10 and the PC girders 11 and 11' are connected to each other by coupling threaded bars 20 to ends of the screw holes 23' through through-holes 19 of duct pipes 18 fixed to ⊏-shaped angles 17 provided at ends of the PC girders 11 and 11' as illustrated in FIG. 6A.

However, in the above background technology, high-strength mortar is injected into empty oval spaces 6 of PC column connection parts and rebars of PC members are interconnected at spliced parts. According to the above-described connection method, since the high-strength mortar is cured at the spliced parts, coupling force may not be ensured instantaneously and connection performance greatly differs depending on the quality of curing.

In addition, connection members called ductile rods 7 are embedded in a PC member and another PC member to be coupled is bolted to screw holes 9 of the connection members (at least four screw holes in PC connection surfaces) on site.

However, the center locations of the screw holes facing each other to be bolted together should be very accurate. That is, tolerance may not be achieved for on-site errors of PC technology and thus much effort and time are required for accurate location management.

Another background technology of the present invention is disclosed in KR 1071273 entitled "Precast Concrete Column". This background technology discloses 'a PC column including a PC body extending in a vertical direction, a plurality of rebars embedded in the PC body along a length direction of the PC body, a supporting member provided along the length direction of the PC body, wherein at least one of top and bottom ends thereof is embedded in the PC body and a center part thereof is exposed to configure an exposed connection part, and a connection unit including a plurality of joint members coupled to the exposed connection part of the supporting member so as to be connected to PC girders or beams provided in horizontal directions, wherein the joint members are spaced apart from one another to face each other, and each includes a pair of connection parts having a plurality of through-holes into which bolts are inserted, at locations corresponding to each other, and wherein an insertion part extends along the length direction of the PC body between the pair of connection parts such that an end of the PC girder is inserted into the insertion part' as illustrated in FIG. 6B.

However, in the above background technology, continuity in the sectional properties of the PC column and the girders and the tensile capacity of rebars therein may not be ensured, and slab and wall rebars may not be easily coupled to the PC member.

DISCLOSURE

Technical Problem

Therefore, the present invention has been made in view of the above problems, and it is one object of the present invention to provide a precast concrete (PC) member having assemblable plates and fixing channels, capable of configuring the assemblable plates and the fixing channels in a PC member used as a general column, a wall, or a girder or beam to ensure instantaneous coupling force when PC members are coupled together, to achieve tolerance for coupling errors at PC coupling locations and reduction in work time, and to ensure continuity in the tensile capacity of rebars in a PC body, capable of connecting the plates exposed from the PC body to an end of another PC member such as a column, a wall, or a girder or beam using general steel-frame bolting to ensure continuity in the tensile capacity of the rebars in the PC body, and capable of embedding the fixing channels in a side surface of the PC body to continuously and easily transfer the tensile capacity of the rebars of the PC member to be coupled, using a plate assembly and the fixing channels, and to easily fix subsequent cast-in-place rebars to the side surface of the PC body through the fixing channels using T-shaped bolts.

Technical Solution

In accordance with one aspect of the present invention, provided is a precast concrete (PC) member having assemblable plates and fixing channels and including a PC body having a certain length, a plurality of rebars embedded in the PC body along a length direction of the PC body, a plate assembly including one or more pairs of plates spaced apart from one another to face each other, each including a pair of coupling holes at a certain interval, and configured in such a manner that ends of the plates are embedded in and other ends of the plates protrude from one or more length direction-ends of the PC body and that parts of the plates embedded in the PC body are welded to ends of the rebars being in contact with and extending in parallel with the embedded plates, and connection members configured in such a manner that two ends of each connection member are coupled to the coupling holes of a pair of the plates facing each other, using bolts to interconnect the embedded parts of the plates facing each other, and two or more fixing channels embedded at a certain interval in a width-direction side surface or two or more corresponding width-direction side surfaces of the PC body, and each including a U-shaped channel having an opening in a top surface of the U-shaped channel, a plurality of anchor structures coupled to a rear surface of the U-shaped channel, and lips bent inward from the opening of the U-shaped channel.

Toothed gear parts may be provided on inner surfaces of the lips of the fixing channel.

Each of the anchor structures of the fixing channel may include a stem welded to the rear surface of the U-shaped channel and configured as a steel plate, and an anchor head welded to an outer end of the stem and configured as a steel plate.

Reinforcing angles may be vertically coupled to inner corners of the connection members crossing each other in a cross section of the plate assembly.

A plurality of bent rebars may be partially embedded in and partially and perpendicularly protrude from a width-direction side surface of the PC body.

A girder connection part perpendicularly protruding from the PC body by a certain length may be integrally provided on a width-direction side surface of the PC body, and the plate assembly may be configured in such a manner that an end of the plate assembly is embedded in and another end of the plate assembly protrudes from a length-direction outer end of the girder connection part.

The plate assembly may be provided at each of two sides of each of two length-direction ends of the PC body, a plurality of bent rebars may be partially embedded in and partially and perpendicularly protrude from parts between the plate assemblies of the two sides, and two or more fixing channels may be embedded at a certain interval in each of width-direction side surfaces of the PC body.

Advantageous Effects

As apparent from the fore-going, according to the present invention, a precast concrete (PC) member having assemblable plates and fixing channels may equally and continuously transfer the tensile capacity of rebars in a PC body, through the assemblable plates and the fixing channels to a neighboring PC member to be coupled, may fix subsequent cast-in-place rebars (e.g., slab rebars) to a side surface of the PC body by bolting the same to the fixing channels of the PC member, thereby easily and firmly fixing connection parts between the PC member and the cast-in-place rebars to each other, and may easily achieve tolerance for coupling location errors between PC members using the fixing channels and a plate assembly, thereby simply and rapidly completing on-site work.

In addition, since the plate assembly is provided in parallel with rows of the rebars and is welded to the rebars being in contact with and extending in parallel with the embedded plates to ensure continuity in the tensile capacity of the rebars in the PC body, the present invention may be applied to PC members having various cross-sectional shapes, e.g., rectangular, circular, and irregular cross-sectional shapes, and the plate assembly and the fixing channels of each PC member enable firm and rapid coupling between PC members used as columns, walls, girders or beams, etc.

BEST MODE

Figure 1:
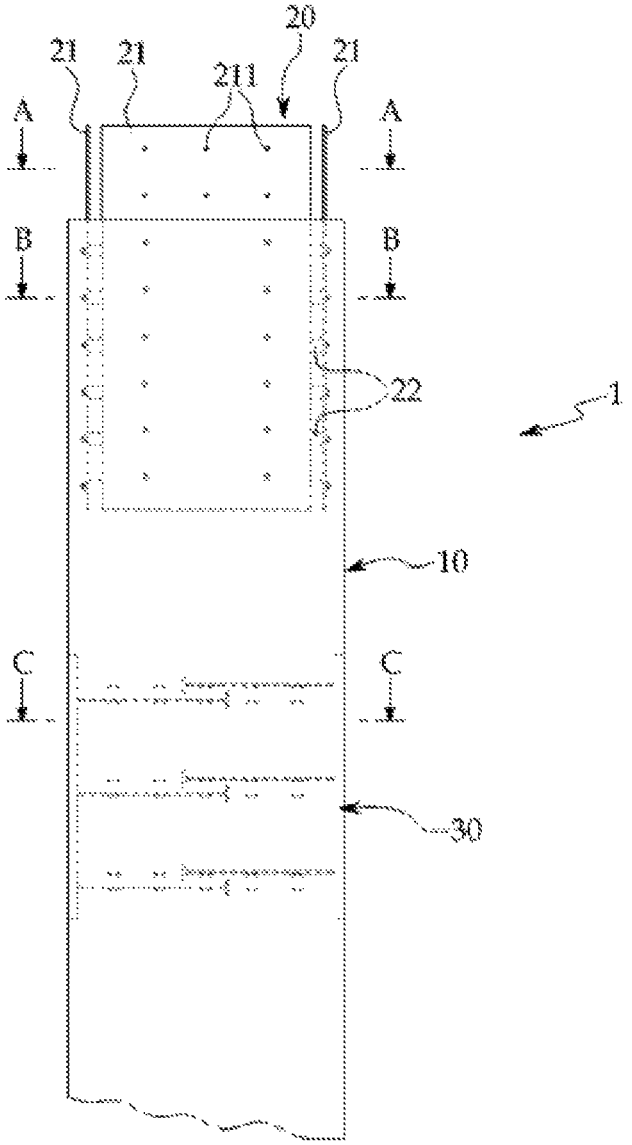
FIG. 1 is a front view of a precast concrete (PC) member having assemblable plates and fixing channels, according to the present invention.

FIG. 1 is a front view of a precast concrete (PC) member having assemblable plates 21 and fixing channels 30, according to the present invention.

As illustrated in FIG. 1, the PC member 1 having assemblable plates and fixing channels according to the present invention includes a PC body 10 having a certain length, a plurality of rebars 11 embedded in the PC body 10 along a length direction of the PC body 10, a plate assembly 20, and the fixing channels 30, and may be used as a column, a girder or beam, a wall, etc.

Figure 2A:
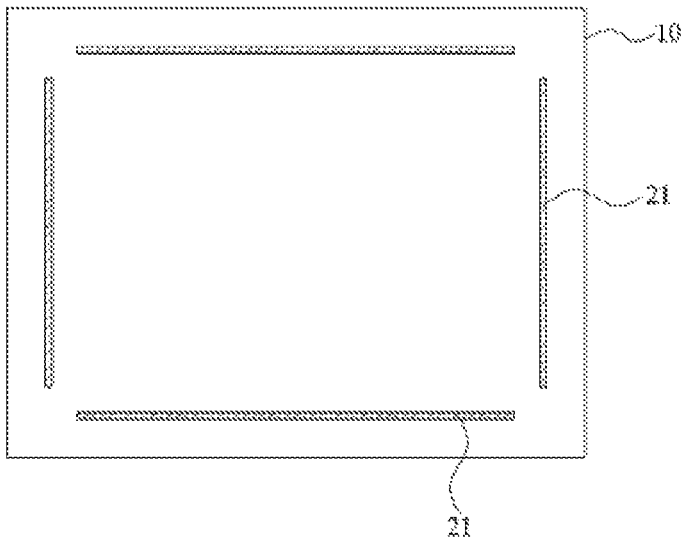
FIGS. 2A, 2B, and 2C are cross-sectional views taken along lines A-A, B-B, and C-C of FIG. 1.
Figure 2B:
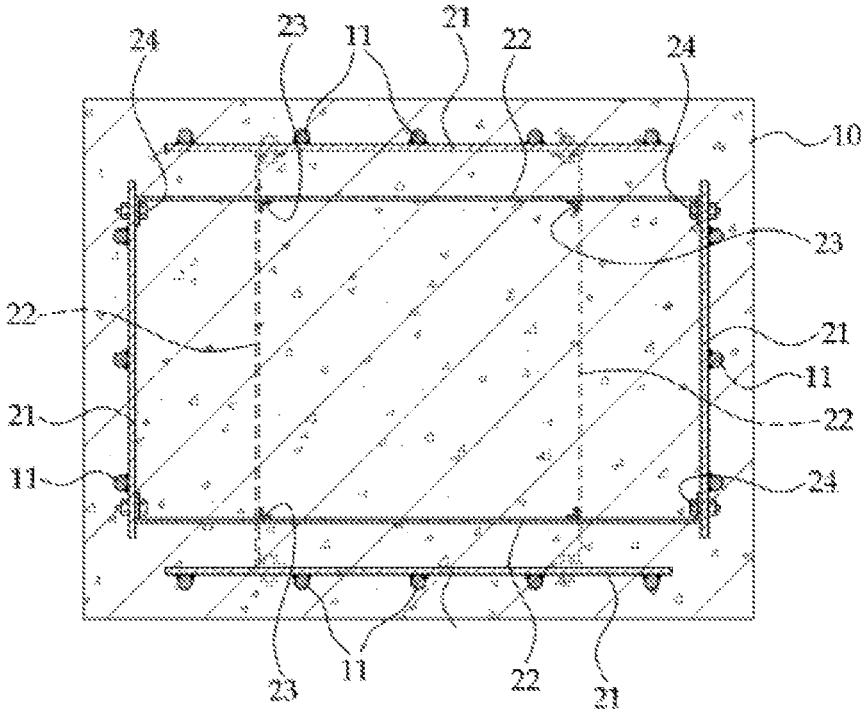
Figure 2C:
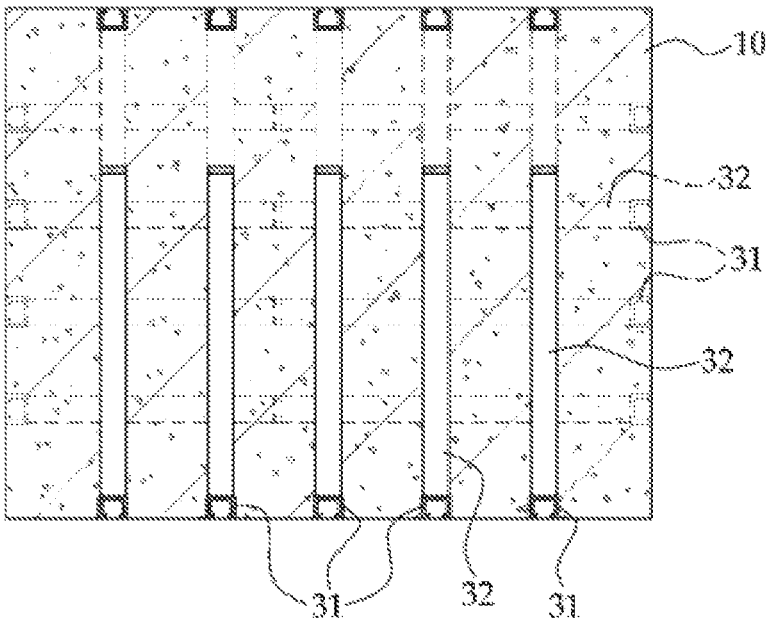

FIGS. 2A, 2B, and 2C are cross-sectional views taken along lines A-A, B-B, and C-C of FIG. 1.

The plate assembly 20 may include two plates 21 spaced apart from one another to face each other, or four plates 21 provided to form a rectangular cross-section as illustrated in FIG. 2A. As illustrated in FIG. 2B, the plates 21 embedded in the PC body 10 to face each other are coupled together using connection members 22. Particularly, the plates 21 embedded in the PC body 10 are provided in parallel with rows of the embedded rebars 11 and are welded to ends of the rebars 11.

In general, the sectional properties of the PC member are determined based on sectional dimensions of the PC body 10 and the rebars 11 embedded in the PC body 10. To ensure continuity in the sectional properties of the PC member, the same embedded depth in concrete and the same tensile capacity as the rebars 11 embedded in the PC member should be ensured in parts where two PC members are interconnected.

Therefore, a bolting-type plate assembly 20 is used to ensure continuity in the embedded depth in concrete of the rebars and to easily adjust the depth by welding the ends of the rebars being in contact with and extending in parallel with the embedded plates to the plates 21. As such, the plates 21 embedded in the PC body 10 are welded to the ends of the rebars 11 and are lap-spliced with the rebars 11 to equally transfer the tensile capacity of the rebars 11 to the plates 21, thereby ensuring continuity in the sectional properties and the tensile capacity of the PC member. However, when general rolled structural steel (e.g., H-beam) is used, the same embedded depth in concrete and the same tensile capacity as the rebars embedded in the PC member may not be easily ensured.

Figure 5A:
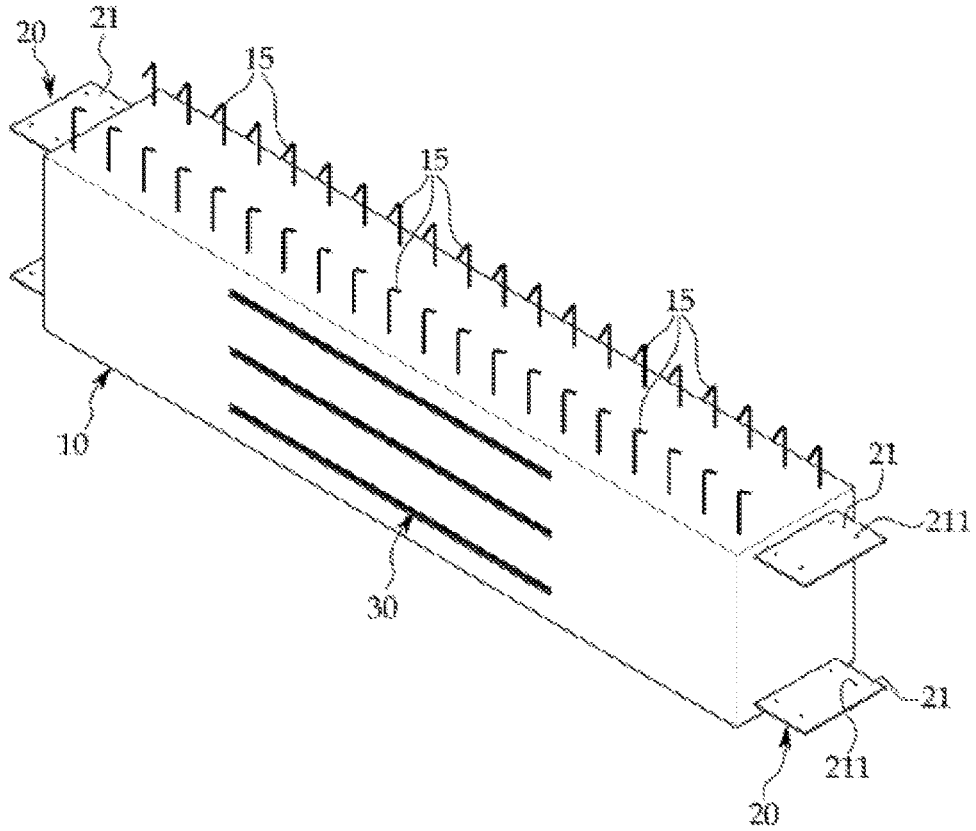
FIGS. 5A, 5B, and 5C are perspective views showing other embodiments of the PC member having assemblable plates and fixing channels according to the present invention.

The PC member 1 having assemblable plates and fixing channels according to the present invention is usable as a column or a girder or beam. As such, when used as a girder or beam, as illustrated in FIG. 5A, two plates 21 may be spaced apart from one another to face each other and thus may be easily coupled not only to the PC member 1 according to the present invention but also to a typical column using brackets. As illustrated in FIGS. 2A and 2B, when used as a column, four plates 21 may be provided to have a rectangular cross-section.

Each of the plates 21 has a certain length and a certain width, and includes coupling holes 211 at a certain interval. When four plates 21 are provided to have a rectangular cross-section, corners of neighboring plates 21 are not in contact with each other but are spaced apart from one another by a certain distance. Thus, when embedded in the PC body 10, the plates 21 do not disconnect inner and outer parts from each other.

Although not shown in the drawings, the plates 21 may have a curvature in a cylindrical column, or two or more plates 21 may be provided at desired geometric locations in an irregular column.

The connection members 22 may have various shapes, e.g., channels, angles, or plates, and reinforcing angles 23 may be coupled to parts where the connection members 22 cross each other.

The above-described bolting part of the plate assembly 20 serves as a shear connector to integrate the PC body 10 and the plates 21 without using stud bolts.

In the present invention, as illustrated in FIG. 2B, the embedded depth in concrete of the rebars 11 vertically embedded in the PC body 10 is constantly maintained and the ends of the rebars 11 are welded to the plates 21.

In general, the rebars 11 are embedded in a reinforced concrete member at an outermost depth in concrete excluding a cover depth of concrete. To weld the ends of the rebars 11 to the plates 21 while constantly maintaining the embedded depth in concrete of the rebars 11, the plates 21 should be assemblable so as to be provided at desired locations based on the predetermined embedded depth in concrete of the rebars 11, as in the plate assembly 20 according to the present invention.

Accordingly, the plates 21 provided in the PC body 10 may be welded to the ends of the rebars 11 being in contact with and extending in parallel with the embedded plates to achieve tensile capacity equal to or greater than that of the embedded rebars 11, thereby ensuring continuity in tensile capacity.

As illustrated in FIG. 1, ends of the plates 21 are embedded in a length-direction end of the PC body 10, and the other ends of the plates 21 protrude from the PC body 10. The parts of the plates 21 embedded in the PC body 10 and facing each other are coupled together using the connection members 22. The connection members 22 may have various shapes, e.g., channels, angles, or plates, and two ends of each connection member 22 are in contact with inner surfaces of the plates 21 facing each other and are coupled thereto using bolts 24. The above-described connection members 22 constantly maintain the distance between the plates 21 facing each other and couple the plates 21 together, thereby increasing rigidity.

In the present invention, each of the connection members 22 is configured as a plate bent to have a ⊏ shape, and two bent ends thereof are coupled to the coupling holes 211 of the plates 21 facing each other, using the bolts 24.

In general, steel plates are stud-welded to ensure integration with concrete.

However, the plate assembly 20 according to the present invention may bolt the steel plates 21 together using the connection members 22 to replace stud-welding for ensuring integration with the PC body 10, and the connection members 22 bolted to the plates 21 not only serve as means for ensuring desired locations (heights) of the plates 21, and but also serve as bent rebars.

The connection members 22 cross each other in a cross section of the plate assembly 20 as illustrated in FIG. 2B, and the reinforcing angles 23 are vertically coupled to inner corners of the connection members 22 crossing each other, thereby reinforcing and maintaining the shape of the plate assembly 20.

The reinforcing angles 23 may use angles having an L-shaped cross section, or may be replaced with members having various cross sections. The reinforcing angles 23 are vertically provided in the PC body 10 only at parts where the connection members 22 are provided.

Since ends of the plates 21 are embedded in the PC body 10 and the other ends of the plates 21 protrude from the PC body 10, the embedded plates 21 may be welded to the rebars 11 provided in the PC body 10 to achieve tensile capacity equal to or greater than that of the rebars 11 being in contact with and extending in parallel with the embedded plates, thereby ensuring continuity in tensile capacity.

Although a conventional coupling method uses couplers for interconnecting rebars, according to the present invention, the plates 21 may protrude from an end of the PC body 10 and the exposed parts of the plates 21 may be connected to an end of a girder or beam using general steel-frame bolting (e.g., high-tension bolting), thereby ensuring continuity in the tensile capacity of the embedded rebars 11.

In addition, since the above-described method according to the present invention may reduce high accuracy in location which is required in the conventional method using couplers, tolerance may be achieved for coupling errors in construction and thus constructability may be enhanced.

As illustrated in FIG. 2C, in the PC member 1 having assemblable plates and fixing channels according to the present invention, the fixing channels 30 are embedded in side surfaces of the PC body 10. For brevity, FIG. 2C does not illustrate the rebars 11 in the PC body 10.

When the fixing channels 30 are embedded in the PC body 10, the fixing channels 30 may be embedded in one or more width-direction surfaces of the PC body 10. Preferably, the fixing channels 30 are embedded in such a manner that a length direction of the fixing channels 30 corresponds to the length direction of the PC body 10, and that openings 312 of U-shaped channels 31 of the fixing channels 30 are exposed from the PC body 10.

Figure 3:
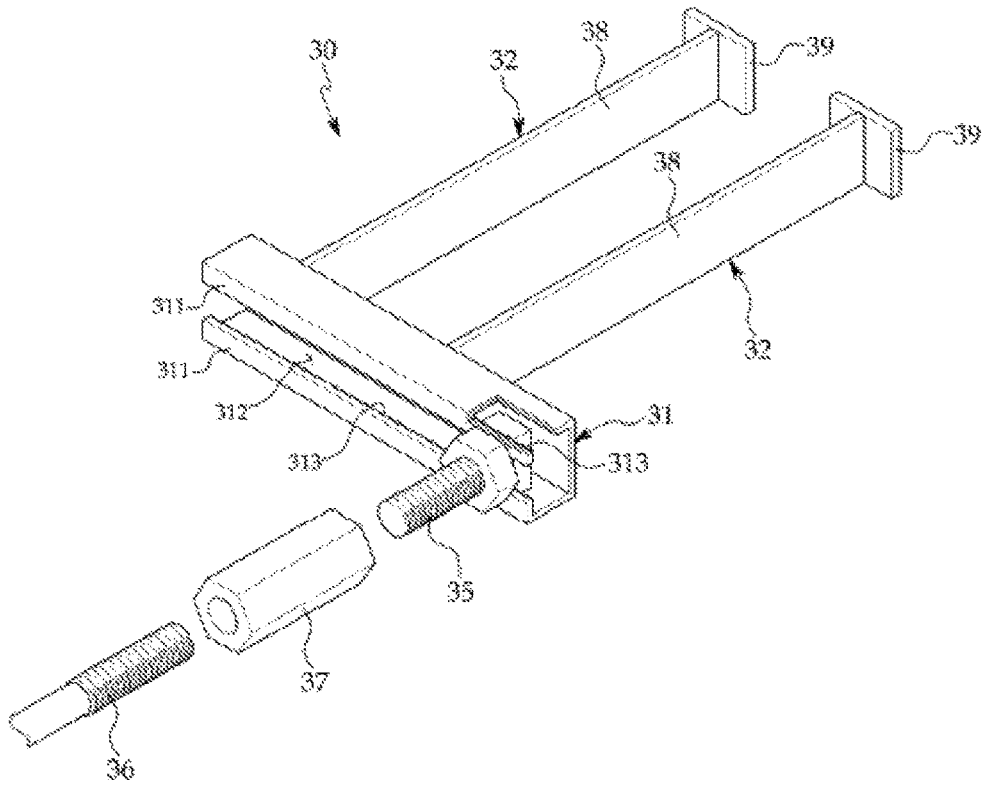
FIG. 3 is a perspective view showing an embodiment of the fixing channel used in the PC member having assemblable plates and fixing channels according to the present invention.

FIG. 3 is a perspective view showing an embodiment of the fixing channel used in the PC member having assemblable plates and fixing channels according to the present invention.

As illustrated in FIG. 3, the fixing channel 30 includes the U-shaped channel 31 having the opening 312 on a top surface thereof, anchor structures 32 coupled to a rear surface of the U-shaped channel 31, and lips 311 bent inward from the opening 312 of the U-shaped channel 31.

Each of the anchor structures 32 of the fixing channel 30 may include an anchor head 39 for exerting fixing force on the PC body 10, and a stem 38 for transferring the fixing force to the fixing channel 30. Since an end of the stem 38 configured as a steel plate is welded to the rear surface of the U-shaped channel 31 and the anchor head 39 configured as a steel plate is welded to the other end of the stem 38, the anchor structure 32 may exert excellent anchorage performance on the PC member when high tensile force is applied.

The anchor structures 32 of the fixing channel 30 illustrated in FIG. 3 merely correspond to an example, and various types (e.g., stud-type) of the anchor structures 32 may be coupled to the rear surface of the U-shaped channel 31.

Preferably, toothed gear parts 313 are provided on inner surfaces of the lips 311 of the fixing channel 30 such that, when a T-shaped bolt 35 is coupled to the U-shaped channel 31 of the fixing channel 30, the T-shaped bolt 35 does not slide along but is firmly fixed to the opening 312 of the U-shaped channel 31.

In this case, toothed gear parts may also be provided on head parts of the T-shaped bolt 35 in contact with the inner surfaces of the lips 311 of the fixing channel 30 and may be engaged with the toothed gear parts of the lips to prevent displacement of the T-shaped bolt 35 from the coupled location.

To couple the fixing channel 30 to a cast-in-place rebar, a dedicated T-shaped bolt 35 in which a T bolt and a rebar are integrated with each other may be used, or a rebar coupler 37 may be used to couple the T-shaped bolt 35 to a threaded rebar 36 as illustrated in FIG. 3.

The above-described fixing channels 30 may be provided at a certain length-direction height or multiple length-direction heights of the PC body 10.

Figure 4:
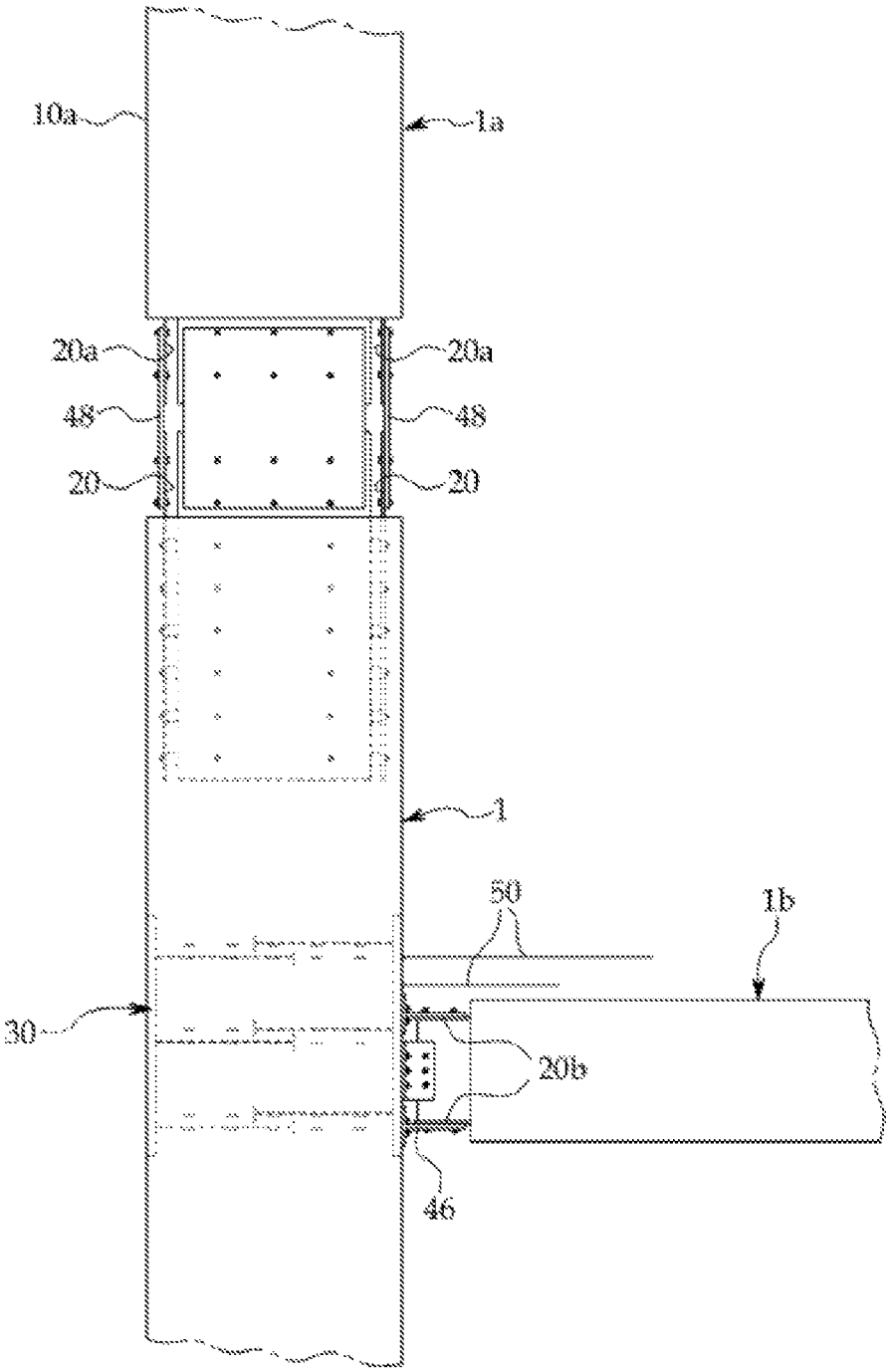
FIG. 4 is a schematic view showing an embodiment of connection parts of the PC member having assemblable plates and fixing channels according to the present invention.

FIG. 4 is a schematic view showing an embodiment of connection parts of the PC member 1 having assemblable plates and fixing channels according to the present invention.

Particularly, operations and functions of the plate assembly 20 and the fixing channels 30 in the PC member 1 having assemblable plates and fixing channels according to the present invention will now be described in detail with reference to FIG. 4. In the present invention, the PC member 1 having assemblable plates and fixing channels may be used as both a column and a girder or beam. For brevity, FIG. 4 illustrates a column 1, an upper column 1*a*, and a girder 1*b*.

As illustrated in FIG. 4, for column-to-column connection, a plate assembly 20*a* under the upper column 1*a* and the plate assembly 20 on the lower column 1 are firmly bolted together using auxiliary hardware 48 such as connection plates.

That is, the plate assemblies 20 and 20*a* of the columns 1 and 1*a* are parts for equally and continuously transferring the tensile capacity and the embedded depth in concrete of rebars in the columns 1 and 1*a*. Accordingly, the plate assemblies 20 and 20*a* and the auxiliary hardware 48 are firmly bolted together. That is, the tensile capacity of rebars in a PC column is equally transferred to a neighboring PC column and PC column connection parts are firmly coupled together using a simple bolting process as in steel-frame work.

As described above, when the columns 1 and 1*a* are coupled together using the plate assemblies 20 and 20*a*, location errors between the connection parts of the columns 1 and 1*a* may be easily adjusted using, for example, slot holes provided in the auxiliary hardware 48 and thus the coupling process may be conveniently performed. After the connection parts of the columns 1 and 1*a* are bolted together, rebars and concrete may be additionally placed to surround the connection parts.

In the present invention, for column-to-girder connection, a plate assembly 20*b* of the girder 1*b* is firmly bolted to the fixing channels 30 provided on a side surface of the column 1, using auxiliary hardware 46 such as split-Ts or angles.

The plate assembly 20*b* of the girder 1*b* is a part for equally and continuously transferring the tensile capacity and the embedded depth in concrete of rebars therein. The plate assembly 20*b* and the auxiliary hardware 46 such as split-Ts or angles are bolted together and the auxiliary hardware 46 is firmly bolted to the fixing channels 30 of the column 1 using the T-shaped bolts 35. Herein, lower rebars in the girder 1*b* may be bolted into the opening 312 of the lower fixing channel 30 of the column 1 using lower auxiliary hardware (e.g., split-T), and upper rebars in the girder 1*b* may be bolted into the opening 312 of the upper fixing channel 30 of the column 1 using upper auxiliary hardware (e.g., split-T).

That is, the tensile capacity of the upper and lower rebars of the girder 1*b* is equally transferred to the column 1 and PC connection parts are firmly coupled together using a simple bolting process.

When the girder 1*b* is coupled to the fixing channels 30 of the column 1, vertical location errors may be easily adjusted along the U-shaped opening 312 of the U-shaped channel 31 and thus the coupling process may be conveniently performed. In addition, horizontal location errors between the girder 1*b* and the column 1 may be easily adjusted using the plate assembly 20*b* and, for example, slot holes provided in the auxiliary hardware 46 and thus the coupling process may be conveniently performed. After the PC connection parts are bolted together, rebars and concrete may be additionally placed to surround the connection parts.

As illustrated in FIG. 4, due to the fixing channels 30 provided in the column 1, cast-in-place rebars 50 such as slab rebars may be easily fixed to the fixing channels 30 and thus the cast-in-place slab rebars may be firmly coupled to the column 1.

When the cast-in-place rebars are coupled, vertical location errors may be easily adjusted along the U-shaped opening 312 of the U-shaped channel 31 and thus the coupling process may be conveniently performed.

However, according to a conventional PC connection part coupling method, connection parts are coupled together by making through-holes in a PC column and passing slab rebars therethrough or passing and then straining strands through the column.

In addition, tolerance may not be easily achieved for location errors with respect to the through-holes in the PC member and thus constructability may be deteriorated.

Figure 5B:
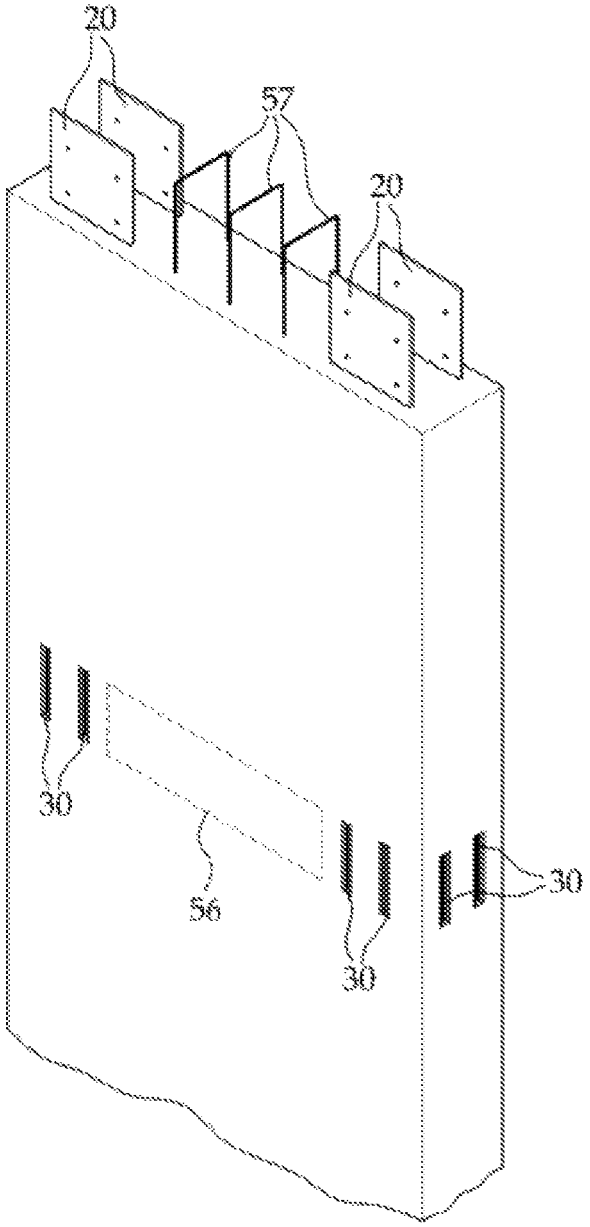
Figure 5C:
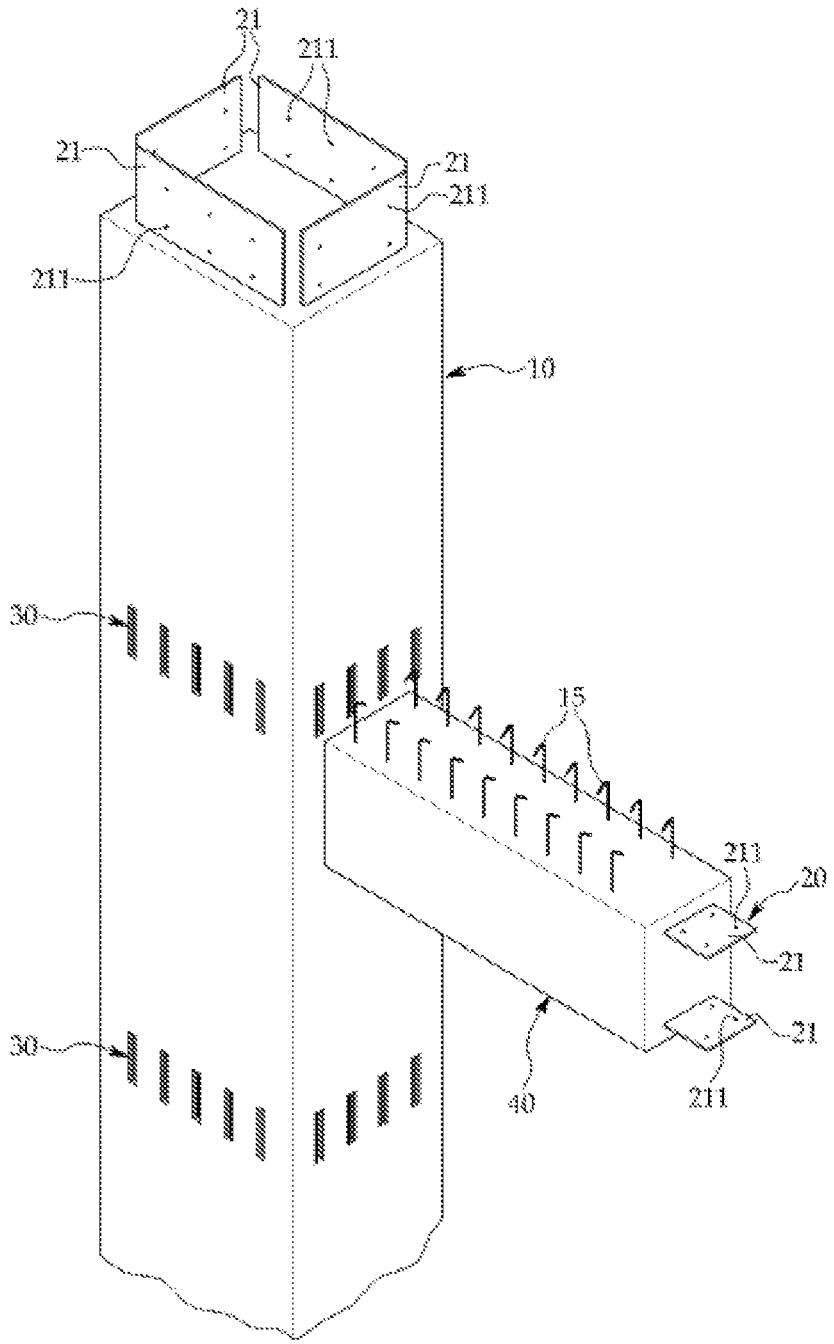
Figure 6A:
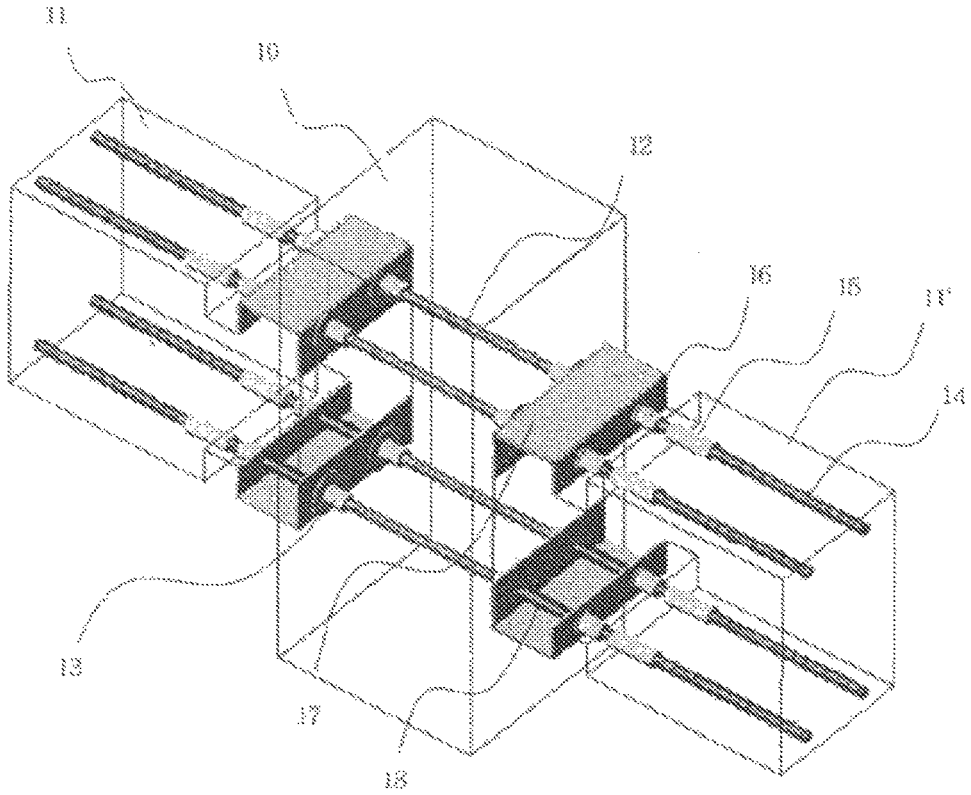
FIGS. 6A and 6B are perspective views of PC columns according to conventional technologies.
Figure 6B:
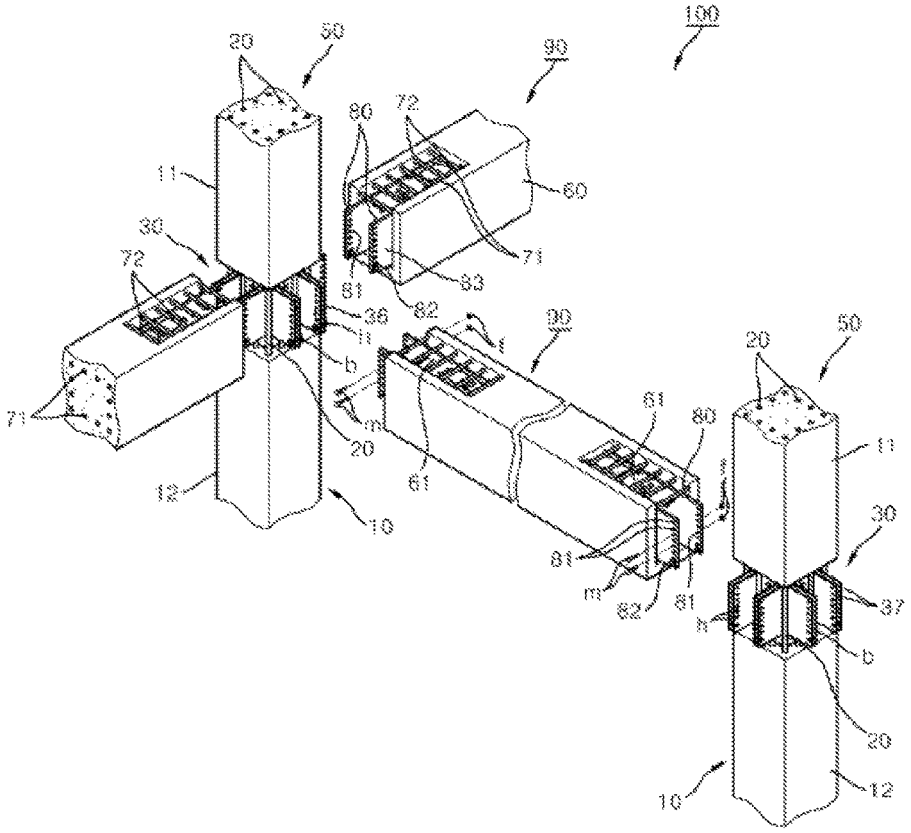

FIGS. 5A, 5B, and 5C are perspective views showing other embodiments of the present invention.

The PC member having assemblable plates and fixing channels according to the present invention may be used as all of a girder or beam, a wall, and a column to which a girder is connected, according to another embodiment. FIG. 5A is a perspective view showing that the present invention is used for a girder or beam, FIG. 5B is a perspective view showing that the present invention is used for a wall, and FIG. 5C is a perspective view showing that the present invention is used for a column-girder connection structure.

In FIG. 5A, the PC member 1 having assemblable plates and fixing channels according to the present invention is used as a girder or beam. When provided in a horizontal direction and used as a girder or beam, the PC member 1 according to the present invention includes a pair of assemblable plates 20 provided at each of two ends of the girder to face each other, fixing channels 30 provided in width-direction side surfaces, and a plurality of bent rebars 15 partially embedded in and partially and perpendicularly protruding from a top surface of the PC body 10 extending in a horizontal direction.

The bent rebars 15 serve to ensure integration with a slab to be provided on the girder.

As described above, when the PC member 1 according to the present invention is used as a girder or beam, prestressed concrete may be easily obtained by applying tendons to two ends thereof to provide additional compression force, and thus a long-span girder compared to a general cast-in-place concrete girder may be formed.

FIG. 5B shows a PC wall having the assemblable plates and the fixing channels, according to the present invention. The plate assembly 20 including a pair of plates facing each other may be provided at each of left and right ends on top and bottom surfaces of the PC body extending in vertical and horizontal directions, a plurality of bent rebars 57 may be partially embedded in and partially and perpendicularly protrude from parts between the plates of the left and right ends, and two or more fixing channels 30 may be embedded at a certain interval in each of front, rear, right and left side surfaces of the PC body extending in vertical and horizontal directions. Herein, the bent rebars 57 of the top and bottom surfaces of the wall are spliced with rebars of lower and upper walls, separately from plate bolting parts.

Bent rebars may be further embedded in a horizontal direction in regions of the left and right side surfaces of the wall, where the fixing channels 30 are not embedded.

In FIG. 5B, a hollow 56 for exposing rebars of the wall may be provided by not filling a center part between the fixing channels 30 with concrete and thus cast-in-place concrete and rebars may pass therethrough.

FIG. 5C is a perspective view showing that the present invention is used for a column-girder connection structure.

As illustrated in FIG. 5C, a girder connection part 40 horizontally protruding by a certain length and made of concrete is integrally provided on a side surface of the PC body 10, and thus a girder or beam may be easily coupled thereto.

That is, when the PC member 1 having assemblable plates and fixing channels according to the present invention is used as a column, the plate assembly 20 may be provided on at least one side surface in such a manner that an end thereof is embedded in and the other end thereof protrudes from a length-direction outer end of the girder connection part 40, and thus a girder or beam may be easily coupled to the plate assembly 20 of the girder connection part 40.

The plate assembly 20 embedded in the girder connection part 40 is configured in the same manner as the plate assembly 20 embedded in the PC body 10, and thus a detailed description thereof is not provided herein.

A plurality of bent rebars 45 may be partially embedded in and partially and perpendicularly protrude from a top surface of the girder connection part 40, and thus slab concrete placed thereon may be easily integrated therewith.

That is, the girder connection part 40 horizontally protruding by a certain length is integrally provided on a side surface of the PC body 10 extending in a vertical direction and having the assemblable plates 21 and the fixing channels 30, and the plate assembly 20 is embedded in a length-direction outer end of the girder connection part 40. Additionally, A plurality of the bent rebars 15 may be partially embedded in and partially and perpendicularly protrude from a top surface of the girder connection part 40.

The above-described PC member having assemblable plates and fixing channels according to the present invention may be used as a PC column, a PC wall, and a PC girder or beam, and connection parts between the PC members may be firmly bolted together on site.

In addition, rebars of a cast-in-place member may be easily fixed through the fixing channels to a side surface of a PC body and PC members may be firmly and easily (high-tension) bolted together using the plates or the fixing channels on site. As such, difficulties and coupling reliability problems of a conventional PC member rebar coupling method (using couplers) which requires accurate coupling locations may be solved.

The invention claimed is:

1. A precast concrete (PC) member having assemblable plates and fixing channels comprising:

a PC body having a length;

a plurality of rebars embedded in the PC body along a length direction of the PC body;

a plate assembly comprising:

one or more pairs of the assemblable plates spaced apart from one another to face each other, each comprising a pair of coupling holes at an interval, and configured to have a structure in which ends of the assemblable plates are embedded in and other ends of the assemblable plates protrude from one or more ends of the PC body and that parts of the assemblable plates embedded in the PC body are welded to ends of the rebars being in contact with and extending in parallel with the embedded assemblable plates; and connection members configured to have a structure in which two ends of each connection member are coupled to the coupling holes of a pair of the assemblable plates facing each other, using bolts to interconnect the embedded parts of the assemblable plates facing each other; and two or more of the fixing channels embedded at an interval in a side surface or two or more corresponding side surfaces of the PC body, and the two or more fixing channels comprising:

a U-shaped channel having an opening in a top surface of the U-shaped channel; and a plurality of anchor structures coupled to a rear surface of the U-shaped channel, wherein a plurality of lips are bent inward from the opening of the U-shaped channel.

2. The PC member according to claim 1, wherein toothed gear parts are provided on inner surfaces of the lips of the fixing channel.

3. The PC member according to claim 1, wherein each of the anchor structures of the fixing channel comprises:

a stem welded to the rear surface of the U-shaped channel and configured as a steel plate; and an anchor head welded to an outer end of the stem and configured as a steel plate.

4. The PC member according to claim 1, wherein reinforcing angles are vertically coupled to inner corners of the connection members crossing each other in a cross section of the plate assembly.

5. The PC member according to claim 1, wherein a plurality of bent rebars are partially embedded in and partially and perpendicularly protrude from a side surface of the PC body.

6. The PC member according to claim 1, wherein a girder connection part perpendicularly protruding from the PC body by a length is integrally provided on a side surface of the PC body, and wherein the plate assembly is configured to have a structure in which an end of the plate assembly is embedded in an end of the girder connection part.

7. The PC member according to claim 1, wherein the plate assembly is provided at each of two sides of each of two ends of the PC body, wherein a plurality of bent rebars are partially embedded in and partially and perpendicularly protrude from parts between the plate assemblies of the two sides, and wherein two or more fixing channels are embedded at a interval in each of side surfaces of the PC body.

* * * * *